US009494039B2

(12) United States Patent
Von Arx et al.

(10) Patent No.: US 9,494,039 B2
(45) Date of Patent: Nov. 15, 2016

(54) STATIONARY GAS TURBINE ARRANGEMENT AND METHOD FOR PERFORMING MAINTENANCE WORK

(71) Applicant: ALSTOM Technology Ltd, Baden (CH)

(72) Inventors: Beat Von Arx, Trimbach (CH); Herbert Brandl, Waldshut-Tiengen (DE)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 666 days.

(21) Appl. No.: 13/950,344

(22) Filed: Jul. 25, 2013

(65) Prior Publication Data

US 2014/0030077 A1 Jan. 30, 2014

(30) Foreign Application Priority Data

Jul. 30, 2012 (EP) ..... 12178536

(51) Int. Cl.
*F01D 5/00* (2006.01)
*F01D 9/04* (2006.01)

(52) U.S. Cl.
CPC ..... *F01D 5/005* (2013.01); *F01D 9/042* (2013.01); *Y10T 29/49229* (2015.01)

(58) Field of Classification Search
CPC ..... F01D 5/005; F01D 9/042; F01D 25/246; F01D 9/023; F01D 9/048; Y10T 29/49229; F05D 2230/80; F05D 2230/70
See application file for complete search history.

(56) References Cited

U.S. PATENT DOCUMENTS

| | | | | |
|---|---|---|---|---|
| 3,004,750 | A | 10/1961 | Broders | |
| 4,643,636 | A | 2/1987 | Libertini et al. | |
| 5,074,752 | A | 12/1991 | Murphy et al. | |
| 5,399,069 | A * | 3/1995 | Marey | F01D 9/042 415/189 |
| 5,743,711 | A * | 4/1998 | Fournier | F01D 5/3015 415/209.2 |
| 6,189,211 | B1 * | 2/2001 | Suter | F01D 25/26 29/402.04 |
| 7,249,462 | B2 * | 7/2007 | Aumont | F01D 9/023 415/209.3 |
| 8,430,629 | B2 * | 4/2013 | Turi | F01D 9/044 415/189 |
| 8,668,448 | B2 * | 3/2014 | Farah | F01D 9/042 415/209.4 |
| 9,238,976 | B2 * | 1/2016 | Ahmad | F01D 9/023 |
| 2002/0184892 | A1 * | 12/2002 | Calvez | F23R 3/60 60/796 |
| 2011/0271689 | A1 * | 11/2011 | Lacy | F01D 9/023 60/806 |
| 2012/0039716 | A1 * | 2/2012 | Ahmad | F01D 9/023 416/198 A |
| 2012/0195746 | A1 * | 8/2012 | Sarda | F01D 9/042 415/201 |
| 2013/0205800 | A1 * | 8/2013 | Ivakitch | F01D 9/042 60/805 |

FOREIGN PATENT DOCUMENTS

| | | |
|---|---|---|
| EP | 2 447 475 | 5/2012 |
| FR | 2 671 140 | 7/1992 |

* cited by examiner

*Primary Examiner* — Igor Kershteyn
*Assistant Examiner* — Eldon Brockman
(74) *Attorney, Agent, or Firm* — Buchanan Ingersoll & Rooney PC

(57) ABSTRACT

The invention refers to a stationary gas turbine arrangement with at least one turbine stage that includes at least a first row of vanes being mounted at a stationary component arranged radially outside of the first row of vanes and extending radially into an annular entrance opening of the turbine stage facing a downstream end of a combustor. Further a method for performing maintenance work on a stationary gas turbine is described. The invention is characterized in that the stationary component provides for each vane a radially orientated through-hole designed and arranged for a radial insertion and removal of the vane, and each of said vanes comprises an airfoil having at its one end directed radially outwards a contour being adapted to close the through-hole airtight by a detachable fixation means.

11 Claims, 8 Drawing Sheets

( State of the Art )

STATIONARY GAS TURBINE ARRANGEMENT AND METHOD FOR PERFORMING MAINTENANCE WORK

CROSS-REFERENCE TO RELATED APPLICATIONS

This application claims priority to European Application 12178536.4 filed Jul. 30, 2012, the contents of which are hereby incorporated in its entirety.

TECHNICAL FIELD

The present invention relates to the field of stationary gas turbine arrangement with at least one turbine stage comprising at least a first row of vanes being mounted at a stationary component arranged radially outwards of the first row of vanes and extending radially into an annular entrance opening of the turbine stage facing a downstream end of a combustor.

BACKGROUND OF THE INVENTION

A typical stationary gas turbine arrangement provides a burner with a combustor in which hot gases are produced which flow into a turbine stage in which the hot gases performing expansion work. The turbine stage consists of a rotary shaft on which a multitude of blades are arranged and grouped in axially blade rows. The rotary unit is encapsulated by a stationary casing on which vanes are mounted which are also divided in axial distributed vane rows each extending between the blade rows. For performing maintenance work on a typical stationary gas turbine, it is necessary to lift the uppercasing half of the turbine stage to get access to the rotary unit. In most of the cases, it is unavoidable to remove also the rotary unit from the lower casing half for further disassembling work. It is a matter of fact that maintenance work on conventional stationary gas turbines is time and cost consuming which is a significant disadvantage for the gas turbine operating company.

Basically it is known that for inspection work inside the outer casing of a turbine stage so called manholes are integrated, so that worker person can gain access to the inner core of the stationary components of the first turbine stage. However, it is not possible to get a direct access to the vanes or blades extending inside the turbine stage because the stationary components, which carry the blades divided in several axially blade rows are typically manufactured in one piece having an axial extension of the length of the turbine stage. In FIG. 2, a rough sketch illustrates a longitudinal section view through the first stage gas turbine in the region of the first vane 1 and blade 2. Hot gases 3, which are produced inside a combustor 4 flow through the funnel shaped entrance opening 5 of a first turbine stage 6. Hot gases 3 pass in axial direction through circumferential interspaces between the blades 1, which are arranged circumferentially around the rotor axis 7 of the rotor unit 8. Each vane 1 provides a radial outer platform 9, an airfoil 1' and a radial inner platform 10. The radial outer platform 9 contains mounting hooks 11, which are inserted into mounting groves 12 of the stationary component 13 of the first turbine stage. The inner platform 10 of vane 1 typically encloses a gap 14 with the inner combustor liner 15 through which a purge flow of cooling medium 16 can be injected into the hot gas flow 3. In the same way a purge flow of cooling medium 16' is injected through a gap 14' that is enclosed by parts of the stationary component 13, the upstream edge of the platform 9 of vane 1 and the outer combustor liner 15'. Downstream the outer platform 9 a heat shield 9' is mounted inside of the stationary component 13 which prevents overheating of the inner faced areas of the stationary component in the same way as in case of the outer platform 9.

EP 2 447 475 A2 discloses an airfoil attachment arrangement in which the airfoil 46 is mounted between an outer and inner platform 48, 50. For mounting and demounting purposes in the outer platform 50, an aperture 90 is processed through which the airfoil can be moved radially. Also at the inner platform 48, (see FIG. 11) there is an opening (see FIGS. 11 to 13) through which the radial inner end of the airfoil 46 penetrates partially. Both ends of the airfoil 46 are fixed by retention assemblies. FIGS. 4 and 5 show a retention assembly 54 for fixing the radial outward end of the airfoil 46. FIG. 12 shows a retention assembly 126 for fixing the radially inner end of the airfoil 46.

U.S. Pat. No. 6,189,211 B1 discloses a method and arrangement for carrying out repair and/or maintenance work in the inner casing of a multi-shell turbo machine. For getting access to the vanes of the first row a man hole 21 is provided within the outer casing of the gas turbine plant. For getting access to the row of vanes, the top part of the combustion chamber casing 12 can be lifted off by a lifting device 33 as disclosed in FIG. 2.

U.S. Pat. No. 3,004,750 A discloses a stator for compressor or turbine arrangement which shows especially turbine arrangement which shows especially in FIGS. 1 to 4 that in a stationary component which is the shroud 2 several through-holes 8 are provided through each of which a vane 6 can be inserted. Each vane 6 provides at its radially outer end a so called foot 10 overlying the outer surface of the outer shroud 2, so that when the vane 6 is inserted into the slot 8, the slot is sealed air tightly especially by welding 12 the foot 10 against the outer surface of the shroud 2. The radially inner end of the vane 6 extends into a slot 26 in the inner shroud 4. Inside the slot 26, there is a spring pin 32, which provides a damping effect on the vane 6.

A similar construction of mounting of vanes 34 within a gas turbine engine is disclosed in U.S. Pat. No. 4,643,636 A, which shows an assembly including a ceramic inner and outer shroud rings in which recesses are provided through which vanes can radially mounted therein. For securing of the vanes a ceramic outer support ring 40 slides over the outer shroud ring FR 2 671 140 A1 discloses guide vanes for a turbo machine compressor (see FIG. 1). Inside the outer shroud segment 2, through-holes 7 are provided through which vanes 3 can be inserted radially. The radially inner end of the vane is received by a slot of an inner ring segment 4. The vane 3 can be secured by a fixing plate 9, which is pressed inside a recess 10 at a mounting device 8 fixed on the outer shroud 2.

SUMMARY

It is an object of the invention to provide a stationary gas turbine arrangement with at least one turbine stage comprising at least a first row of vanes being mounted at a stationary component arranged radially outside of the first row of vanes and extending radially into an annular entrance opening of the turbine stage facing a downstream end of a combustor, which shall enable to reduce significantly the dissembling and assembling work for performing maintenance work on the stationary gas turbine. Especially the lift off process of the uppercasing half of the turbine stage casing shall be avoided.

The object is achieved by the sum total of the features of claim 1. Claim 6 is directed to a method for performing maintenance work on a stationary gas turbine. The invention can be modified advantageously by the features disclosed in the sub claims as well in the following description especially referring to preferred embodiments.

The inventive idea leaves the use of typical vanes consisting of an airfoil, an inner, and an outer platform made in one piece as depicted and explained in connection with FIG. 2. Especially by using a vane, which can be assembled by at least two separate parts, i.e. a separate airfoil and outer platform and a separate inner platform, preconditions are created to provide a direct access to the inner region of a first turbine stage without removing the uppercasing half of the turbine stage. It is also possible to use vanes of three separable parts, i.e. outer platform, airfoil, and inner platform. The inventive stationary gas turbine arrangement provides a radially orientated through-hole within the stationary component for each vane designed and arranged such that a radial insertion and removal of the airfoil of the vane is possible. Typically, the cross section of such a through-hole is in the shape of the largest airfoil profile so that the airfoil of the vane can be moved through the through-hole in its entire airfoil length.

In a preferred first embodiment, the airfoil of each vane has at its end directed radially inwards an extension for inserting into a recess of an inner platform for the purpose of a detachable fixation. As it will be described later, the inner platform is connected with an inner structure respectively inner component of the turbine stage.

The other end of the airfoil directed radially outwards provides a contour, which is adapted such the through hole can be closed airtight by using an additional detachable fixation means. Therefore, in an assembled state the airfoil of the vane is detachable fixed at both ends in contrast to the embodiment according to state of the art shown in FIG. 2 in which the inner platform is spaced from the inner structures of the turbine stage respectively spaced from the inner combustor liner.

In another embodiment the outer end of the airfoil, which is named as other end directed radially outwards, can be non detachable connected, i.e. in one piece, with an outer platform having a platform shape which fits into the through-hole in the stationary component such that the outer platform closes the through-hole airtight by suitable fixation means.

In a further embodiment the airfoil of each vane has at its end directed radially inwards an inner platform or at least a little shape in the form of an inner platform which is spaced inwards to components of the turbine stage so that a cooling channel is limited through which a purge flow of cooling medium can be injected into the hot gas channel of the turbine stage. The outer end of the airfoil provides at least a contour which is adapted such the through hole can be closed airtight by using an additional detachable fixation means.

In all cases of embodiments according to the invention, it is possible to insert or remove the airfoil of the vane radially through the through-hole inside the stationary component.

In case of a fixed position, by at least the fixing means at the outer end of the airfoil, the airfoil of the vane stays in close contact or is connected in one piece with the inner platform which boarders the hot gas flow through the turbine stage towards the inner diameter of the hot gas flow channel of the turbine stage. On the other hand the outer platform which is connected with the airfoil in a flush manner or which is manufactured in one piece with the airfoil borders the hot gas flow channel radially outwards. All inner and outer platforms of the vanes of the first row being aligned adjacent to each other in circumferential direction limit an annual hot gas flow in the area of the entrance opening of the turbine stage.

In case of a detachable fixation between the inner end of the airfoil and the inner platform as mentioned before in connection with the first preferred embodiment the inner platform provides at least one recess for insertion the hook like extension of the airfoil at its radially inwards directed end so that the airfoil is fixed at least in axial and circumferential direction of the turbine stage. As it will be described later in reference to an illustrated embodiment the hook like extension has a cross like cross section, which is adapted to a groove inside the inner platform. The recess inside the inner platform provides at least one position for insertion or removal at which the recess provides an opening through which the hook like extension of the airfoil can be inserted completely only by radial movement. The shape of the extension of the airfoil and the recess in the inner platform is preferably adapted to each other like a spring nut connection.

For insertion or removal purpose it is possible to handle the airfoil only at its radially outwards directed end which is a remarkable feature for performing maintenance work at the turbine stage without the need of lift of the upper casing half of the turbine stage as will described later.

A further opportunity for repair work at the first turbine stage it is favorable that the inner platform is separately fixed to the inner structure. In a preferred embodiment the inner platform is detachably mounted to an intermediated piece, which is also detachably mounted to the inner structure respectively inner component of the turbine stage. Hereto the intermediate piece provides at least one recess for insertion a hook like extension of the inner platform for axially, radially and circumferentially fixation of the inner platform. Basically, the intermediate piece allows some movement of the inner platform in axial, circumferential, and radial direction. There are some axial, circumferential, and radial stops in the intermediate piece to prevent the inner platform from unrestrained movements. With the axial and circumferential stop the vane airfoil is not cantilevered but supported at the outer and inner platform. An additional spring type feature presses the inner platform against a radial stop within the intermediate piece, so that the airfoil can be mounted into the outer and inner platform by sliding the airfoil radially inwards from a space above the outer platform liner.

The connection techniques used for connecting the airfoil with the inner platform, the inner platform with the intermediate piece and the intermediate piece with the inner structure of the turbine stage are chose suitably such a worker can easily mount or dismantle each of the connections easily without the need of much mounting space.

Typically a turbine stage of a gas turbine arrangement is encapsulated by a casing in which at least one manhole is provided to get access for a worker to the inner section of the stationary components of the turbine stage. Inside the casing is enough space for a worker to mount or demount at least one vane by radially insertion and/or removal the airfoil through the through-hole of the stationary component. In case of removing a for example defective airfoil of a vane a worker has access to the fixation means which fixes the airfoil of the defective vane with the stationary component. After releasing the fixation means the worker has access to the radially outwards directed end of the airfoil so that the worker can handle the airfoil at its airfoil tip. Now it is possible to remove the airfoil at its extension radially out of the recess of the inner platform and to remove the airfoil completely out of the turbine stage through the through hole inside the stationary component.

Since all vanes of the first vane row are equipped with such fixation means inventively it is possible to remove one after the other all vanes out of the turbine stage.

For further maintenance work especially at the first row of blades it is possible to get a direct access by entering the space of the combustor through a further manhole, for example by removing the burner for getting access into the combustor through the burner opening. In a next step it is possible to remove the inner platform and following the intermediate piece to get a direct access to the first blade row.

Basically the inventive attachment of the vanes is not limited to vanes arranged in the first row of a gas turbine, so that all vanes of a gas turbine can be fixed at their outer end of the airfoil in a detachable manner for an easy inspection. More details are given in combination with the following illustrated embodiments.

BRIEF DESCRIPTION OF THE FIGURES

The invention shall subsequently be explained in more detail based on exemplary embodiments in conjunction with the drawings. In the drawings

DETAILED DESCRIPTION

Figure 1:
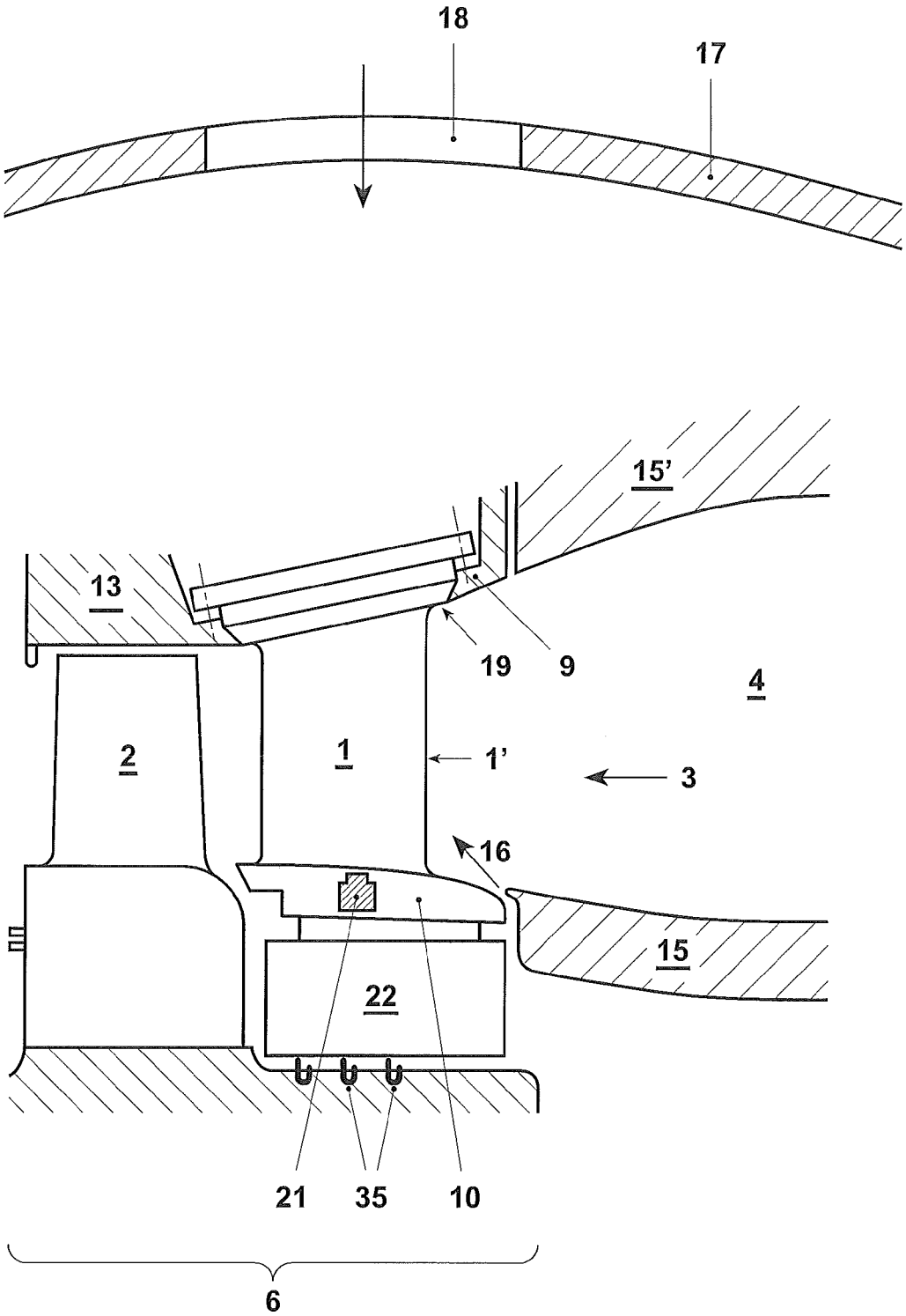
FIG. 1 shows a rough sketch of a longitudinal section through a part of a first turbine stage with a combustor exit.

FIG. 1 shows a rough schematically longitudinal section of a first turbine stage 6, which is downstream arranged to a combustor 4. The turbine stage 6 provides a first row of vanes 1, which is followed in axial flow direction by a first row of blades 2. To get a direct access to the stationary components 13 of the turbine stage 6 inside a casing 17 encapsulating at least parts of turbine stage 6 as well parts of the combustor 4 at least one manhole 18 is provided which is lockable air tightly.

Each vane 1 of the first row of vanes is assembled in parts, so that the airfoil 1', the inner platform 10 and the outer platform 9 are separate parts. In case of the embodiment shown in FIG. 1 it is assumed that the outer platform 9 of the vane is part of the stationary component 13 of the turbine stage. The outer platform 9 provides a through hole 19, which is typically adapted to the largest cross section of the profile of the airfoil 1' of the vane 1. The radially outward directed end of the airfoil 1' has a shape adapted to the shape of the through hole 19 so that the end of the airfoil tip closes the through hole 19 air tightly.

Further there are fixation means 20 (shown in FIG. 5) which connects the radially outwards end of the airfoil 1' with the stationary component 13 respectively with the outer platform 9. The radially inwards directed end of the airfoil 1' provides a hook like extension 21, which is inserted into the inner platform 10, which is connected to an intermediate piece 22 being detachably fixed with inner structures of the turbine stage 6.

Figure 2:
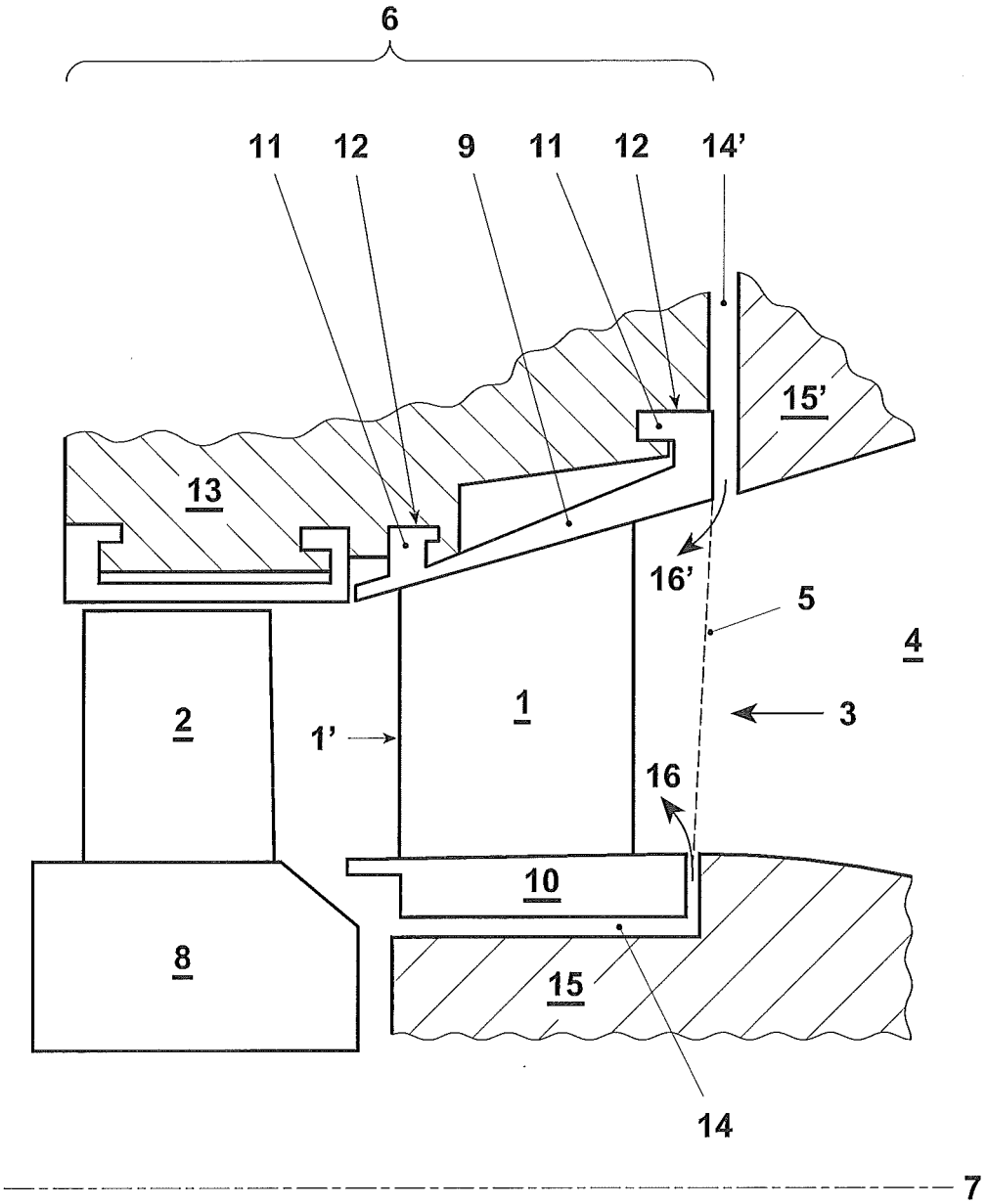
FIG. 2 shows a rough longitudinal section through the first turbine stage according to state of the art.

The airfoil 1' of the vane 1 is connected radially with its outer and inner end. In addition by separating the outer platform from the airfoil 1' it is possible to design the outer platform 9 integrally with the outer combustor liner 15' to remove the leakage line 14' as explained in FIG. 2. Of course, it is possible too to design the outer platform 9 and the outer combustor liner 15' as separate parts, which can enclose a purge flow gap 14' as in case of FIG. 2.

On the other side the mating faces of the inner platform 10 and the inner combustor liner 15 are inclined more to aerodynamically better introduce the purge flow into the main flow 3. The new design allows further an overlap of the inner platform 10 and the inner combustor liner 15.

Figure 3A:
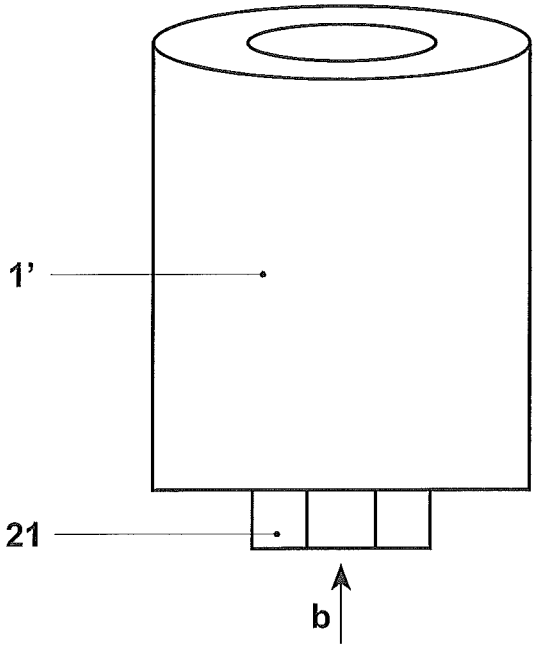
FIGS. 3*a*, 3*b*, 3*c*, and 3*d* show an airfoil with extension and an inner platform.
Figure 3B:
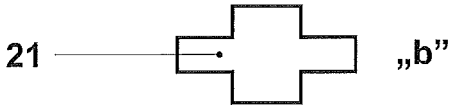
Figure 3C:
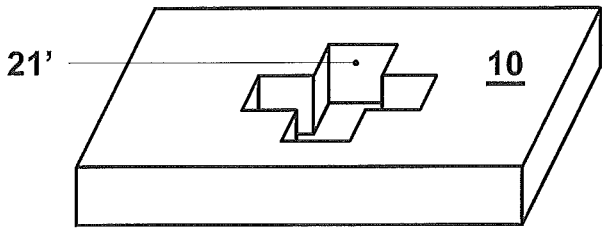

FIG. 3*a* shows a side view of an airfoil 1' of a vane having an end directed inwardly at which a hook like extension 21 is arranged protruding over the length of the airfoil 1'. The extension 21 has a cross like cross-section, which is illustrated in FIG. 3*b*. The inner platform 10, which is illustrated in FIG. 3*c*, has a recess 21' of cross like cross section for insertion the extension 21 only by radial movement. The depth of the recess 21' is larger than the radial length of the extension 21, so that radial movement of the extension 21 within the recess 21' remains possible for example to compensate different thermal expansion effects between the turbine components. Due to the cross sectional shape of the extension 21 and the recess 21', the airfoil is fixed axially and in circumferential direction.

Figure 3D:
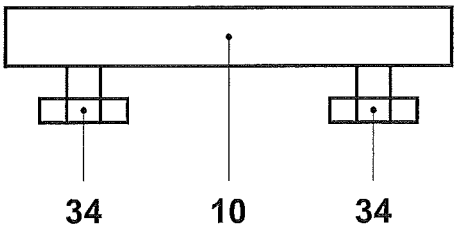

FIG. 3*d* shows a side view of the inner platform 10, which also provides at its bottom face two hooks 34 for mounting in the intermediate piece 22.

Figure 4B:
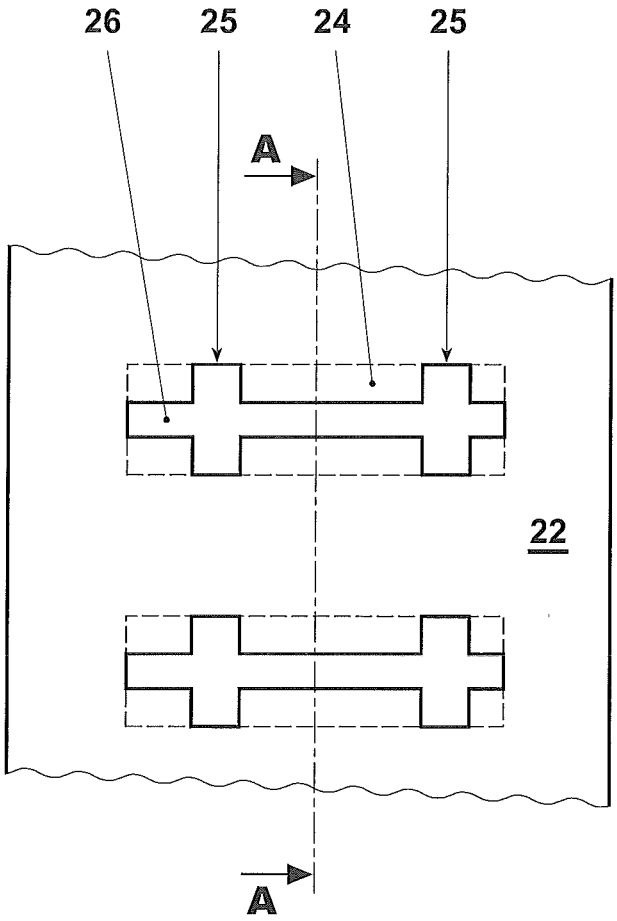
FIGS. 4*a* and 4*b* show a cross sectional and top view of an intermediate piece.
Figure 4A:
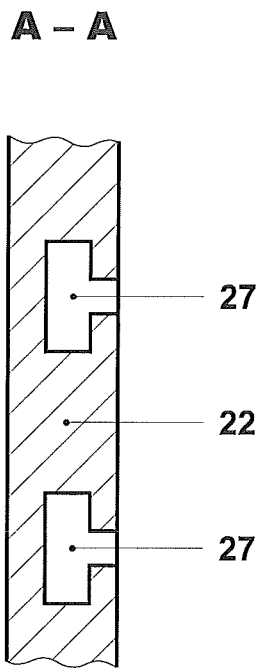

FIGS. 4*a* and 4*b* show a cross sectional view as well a top view of recesses inside an intermediate piece 22. In case of the illustrated embodiment the intermediate piece 22 provides two separate recesses 24 each of the recesses can receive the hooks 34 of one inner plate 10. So it is possible to fix at least one inner plate 10 at one inter mediate piece 22. Each of the recesses 24 shown in FIG. 4*b* has openings 25 to receive a hook 34 of the inner platform 10, which typical has a T-like cross section. Further the recess 24 provides an axial groove 26 having also a T-cross section 27 as illustrated in FIG. 4*a* shows a section view along the section line A-A. By sliding the T-shaped hooks 34 axially along the recess 24 a position can be reached in which the inner platform 10 is fixed radially, axially and in circumferentially direction.

Figure 5A:
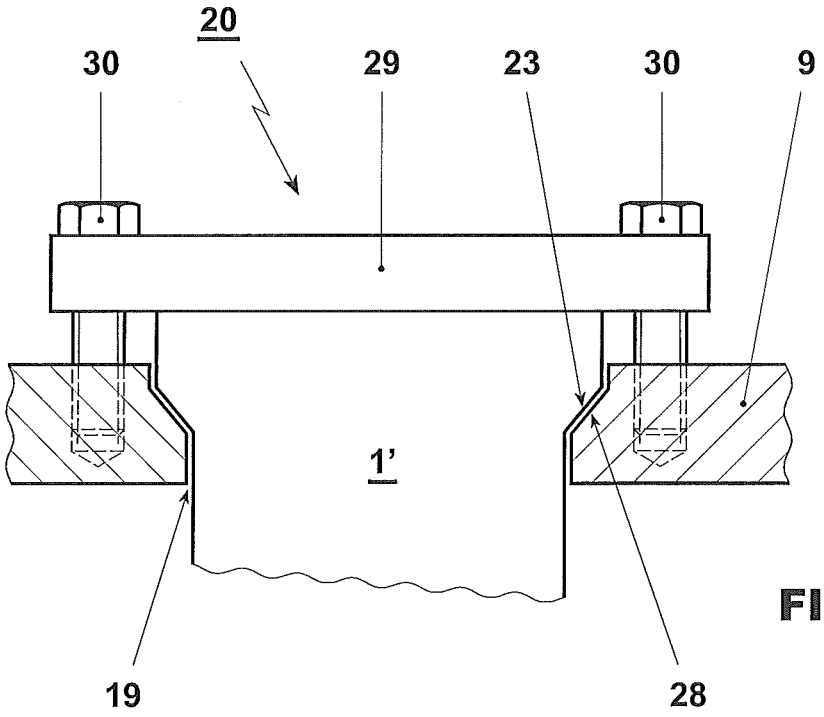
FIGS. 5*a* and 5*b* are sectional views through the radially outward directed end of the airfoil with fixation means to the outer platform.
Figure 5B:
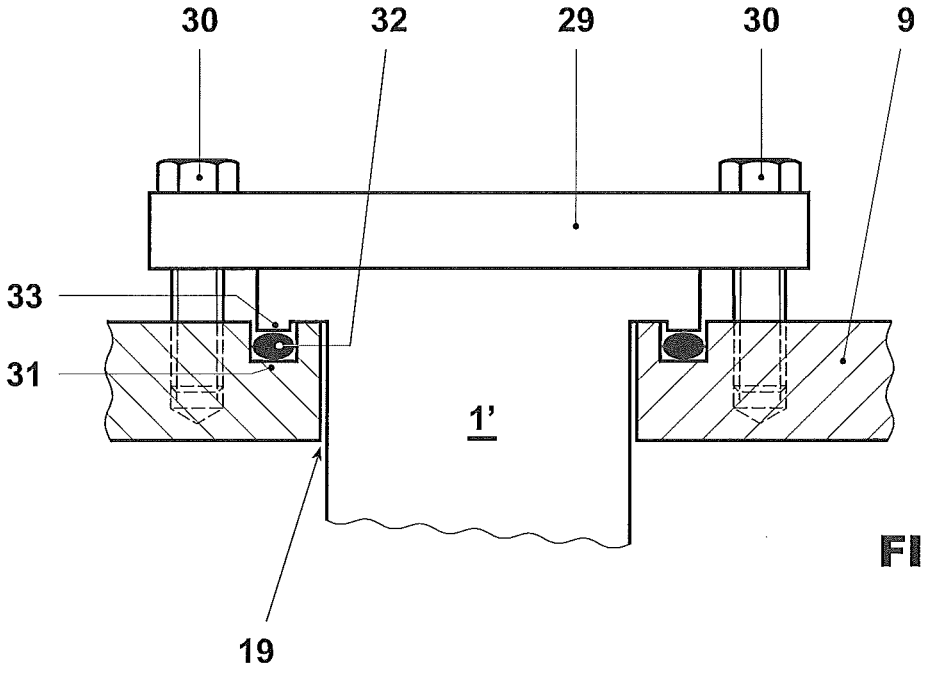

FIGS. 5*a* and 5*b* illustrate sectional views of two alternative embodiments of a fixation means 20 for the outer directed end of an airfoil 1'. The embodiment shown in FIG. 5*a* illustrates the outer platform 9 having a through-hole 19 providing a contoured rim surface 28 at which the outer end of the airfoil 1' aligns with its contour 23 air tightly. To fix and press the outer end of the airfoil 1' against the through hole 19 a fixation means 20 is used which is a bar 29 fixed by screws 30 onto the outer platform 9 by pressing the airfoil 1' directed radially inwards.

In FIG. 5*b* another sealing and fixing mechanism is discloses. Here the upper end of the airfoil 1' has a protruding collar 33 which is pressed by the bar 29 into a nut like recess 31 inside the outer platform 9 in which a chord seal 32 is inserted. In the same way as in FIG. 5*a* the bar 29 is pressed and fixed against the upper end of the airfoils by screws 30.

For performing maintenance work inside the first turbine stage 6 first it is necessary to get an access to the space between the casing 17 and the stationary components 13 of the stationary turbine 6, see FIG. 1. A worker man has to open the man hole 18 above the first stage vane. In a second step the worker has to remove the fixation means 20 so that the airfoil 1' can be radially drawn out of the gas turbine. In response to the extent of the maintenance work the worker can remove one vane or all vanes 1 in the before manner since all vanes are designed and fixed inside the first row of vanes in the same manner.

Figure 6:
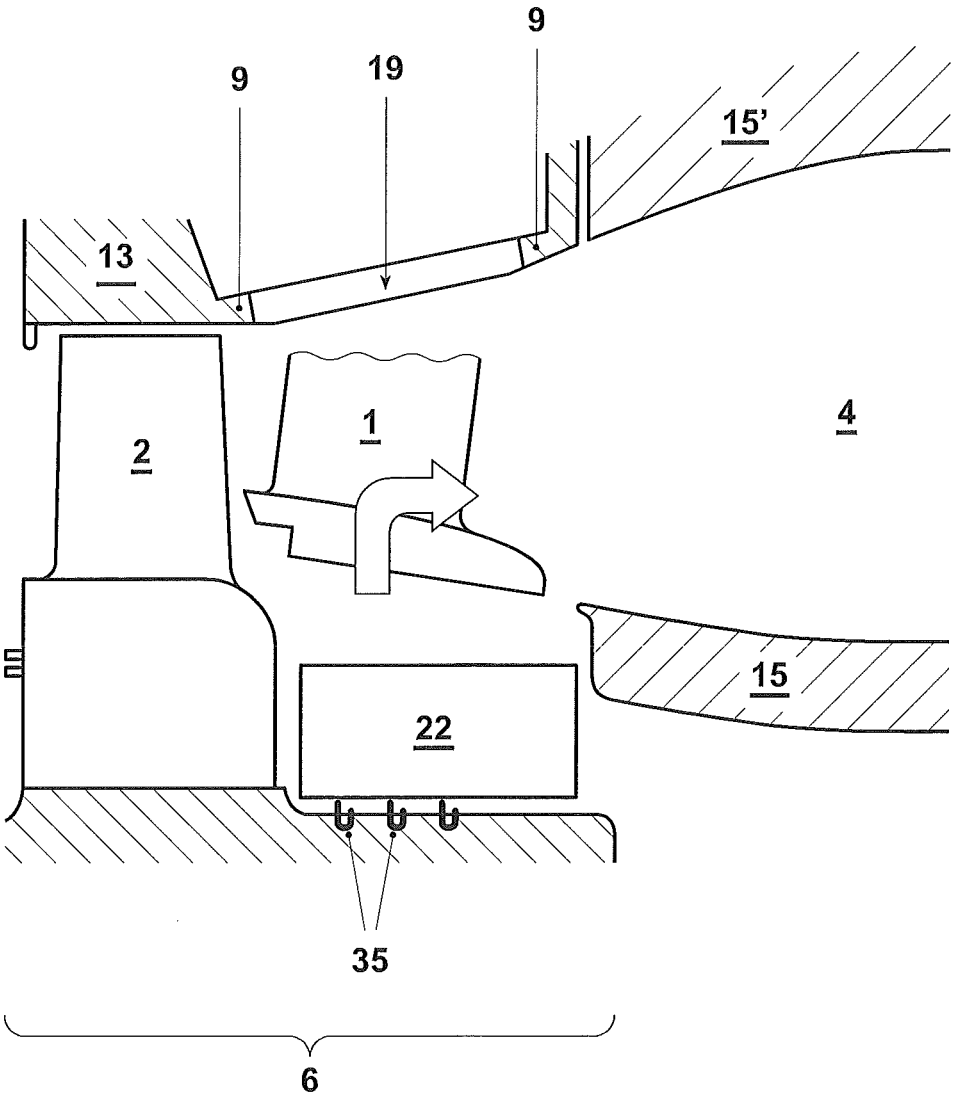
FIGS. 6 and 7 are sketches to illustrate performing maintenance work on a stationary gas turbine and FIG. 8 is an alternative airfoil with an inner platform spaced apart from stationary turbine component.
Figure 7:
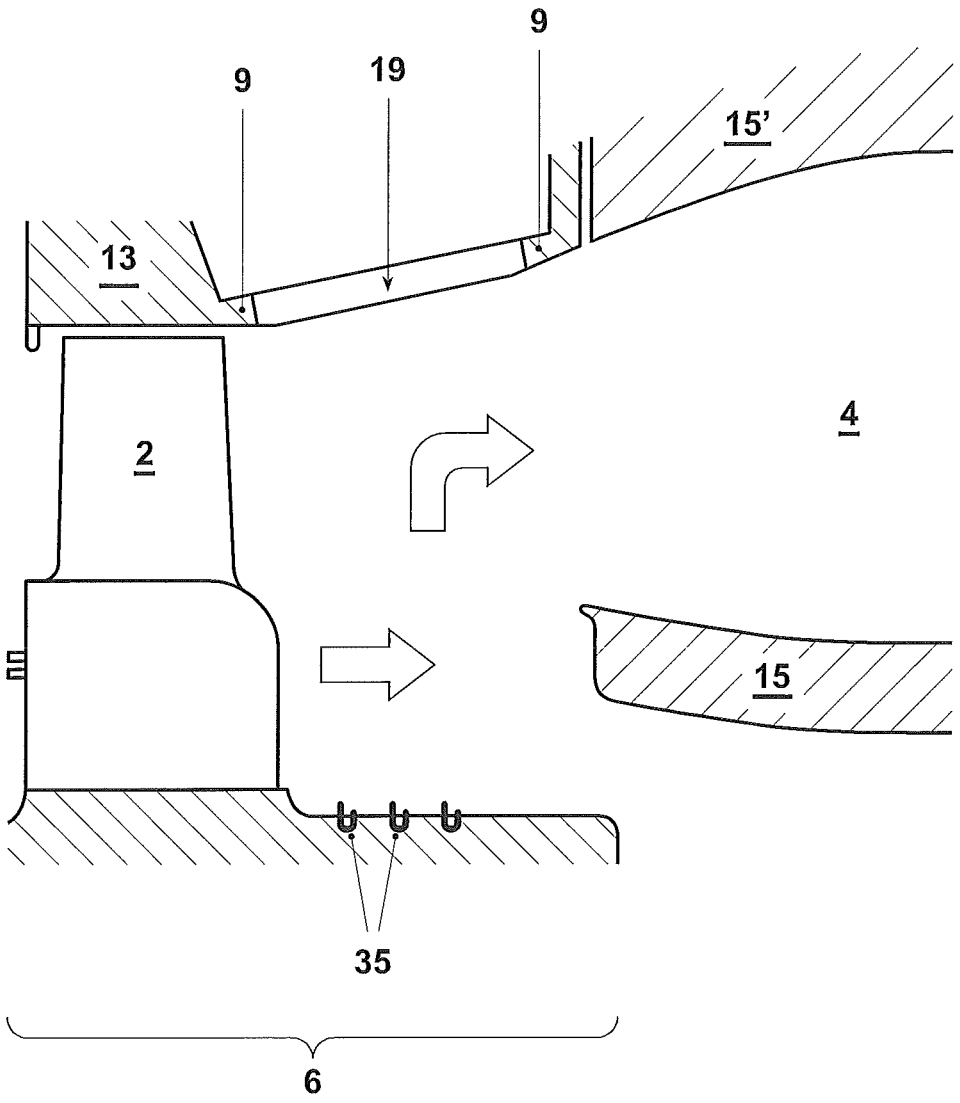

FIG. 6 illustrates the situation in which the vanes are removed completely out of the turbine stage 6, which is shown by the open through-hole 19 inside the outer platform 9. The worker man gains access into the space of the combustor 4 by a further manhole for example by demounting the burner arrangement from the combustor liner (not shown). Now the worker has access to the inner platform 10, which can be removed by pressing down and moving in axial direction towards the combustor liner 15. The inner platform 10 can then be tilted in upstream direction and removed downstream for final release. In a next step the intermediate piece 22 can also be removed completely out of the turbine stage 6 as illustrated in FIG. 7. Now the worker has a direct access to the first stage blade 2. Finally the first stage blade 2 can also be removed, if required it is possible to replace labyrinth sealing 35, which between the intermediate piece 22 and the stationary components of the turbine stage, before reassembling the first turbine stage by carrying out the explain steps in reverse order.

Figure 8:
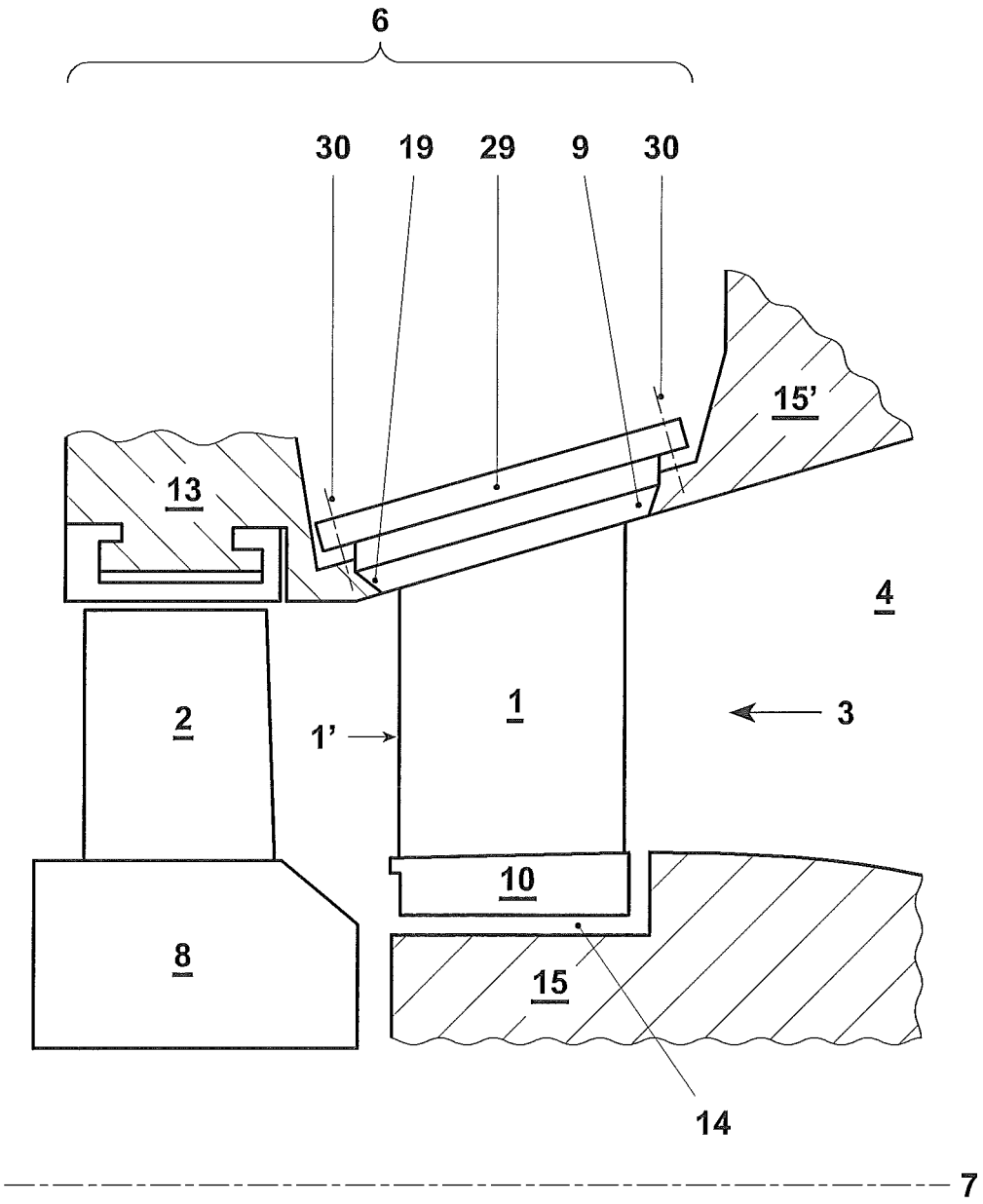

FIG. 8 shows an alternative fixation of a vane 1 which provides an airfoil 1', an inner platform 10 and a small fragment of an outer platform 10 in one piece. The inner platform 10 is spaced apart from the inner combustor liner 15 and limits a gap 14 through which a purge flow of cooling medium can be injected into the hot gas flow 3. The outer platform 9 fits airtight in a through-hole 19 inside the stationary component 13. The outer end of the outer platform 9 is pressed radially inwards by a bar 29 which is fixed by at least two screws 30 at the stationary component 13. The size and shape of the through-hole 19 has to be adapted to the largest diameter of the vane 1, which may be in the section of the inner platform 10 to ensure that the whole vane 1 can be removed completely and easily by radial movement only. All reference signs in FIG. 8 being not mentioned yet concern to components, which are explained in detail in connection with FIG. 2.

The inventive stationary gas turbine arrangement leads to couple of significant advantages as listed in the following:

a) Enabling $1^{st}$ stage disassembly while casing and rotor are not lifted—only manholes must be opened. This is equivalent to a significant reduction in engine outage time. In turn this is a considerable commercial benefit for the gas turbine operating company.

b) Enabling of replacement of individual airfoils, individual inner diameter platforms and individual $1^{st}$ stage blades. This is equivalent to a significant reduction in engine outage time. In turn, this is a considerable commercial benefit for the gas turbine operating company.

c) Due to integration of outer platform into the outer combustor liner cooling air leakage is reduced because gap between combustor liner and vane platform disappears being equivalent to a performance increase.

d) Enabling of reducing aerodynamic losses due to better alignment of purge and main flow from gap between combustor liner and vane platform into the main flow being equivalent to a performance increase.

e) Labyrinth seal can be replaced easily.

What is claimed is:

1. A stationary gas turbine engine with at least one turbine stage, the engine comprising:

at least a first row of vanes being mounted at a stationary component arranged radially outside of the first row of vanes and extending radially into an annular entrance opening of an inner component of the turbine stage facing a downstream end of a combustor, wherein the stationary component provides for each vane a radially orientated through-hole designed and arranged for a radial insertion and removal of the vane, and each of said vanes including an airfoil having at its one end directed radially outwards a contour being adapted to close the through-hole airtight by a detachable fixation, wherein the airfoil of each of the vanes includes at an end directed radially inwards an extension for inserting into a recess of an inner platform, wherein the inner platform is detachably mounted to an intermediate piece which is detachably mounted to the inner component of the turbine stage, wherein the intermediate piece provides at least one recess for insertion of a hook like extension of the inner platform for axially, radially and circumferential fixation of the inner platform, the intermediate piece comprising a labyrinth sealing with respect to the inner component of the turbine stage.

2. The stationary gas turbine engine according to claim 1, wherein the through-hole in the stationary component is of a shape of a largest cross-section of the airfoil of the vane, or the through-hole in the stationary component is of a shape for insertion an outer platform being connected to the outer end of the airfoil directed radially outwards.

3. The stationary gas turbine engine according to claim 1, wherein said inner platform provides at least one recess for insertion of the extension, being hook like in shape, of at least one airfoil, so that the airfoil is detachable fixed at least in axial and circumferential direction of the turbine stage and radially movable within the recess.

4. The stationary gas turbine engine according to claim 1, wherein the turbine stage is encapsulated by a casing in which at least one manhole is provided, and that inside the casing there is enough space for a worker to mount and/or demount at least one vane by radially insertion and/or removal the airfoil through the through-hole of the stationary component.

5. A method for mounting and demounting at least an airfoil of a vane, an inner platform, and an intermediate piece according to claim 1, comprising:

gaining access to the detachable fixation of airfoils of the first row of vanes by entering a casing encapsulating the turbine stage through a manhole inside the casing;

removing the detachable fixation; and removing the airfoil in radial direction through the through-hole.

6. The method according to claim 5, comprising:

reassembling the stationary gas turbine engine by performing each step of the method in a reverse order.

7. A stationary gas turbine engine with at least one turbine stage, the engine comprising:

at least a first row of vanes being mounted at a stationary component arranged radially outside of the first row of vanes and extending radially into an annular entrance opening of an inner component the turbine stage facing a downstream end of a combustor, wherein the stationary component provides for each vane a radially orientated through-hole designed and arranged for a radial insertion and removal of the vane, and each of said vanes including an airfoil having at its one end directed radially outwards a contour being adapted to close the through-hole airtight by a detachable fixation, wherein the airfoil of each of the vanes includes at an end directed radially inwards an extension for inserting into a recess of an inner platform, wherein the inner platform is detachably mounted to an intermediate piece which is detachably mounted to an inner component of the turbine stage, wherein the intermediate piece provides at least one recess for insertion of a hook like extension of the inner platform for axially, radially and circumferential fixation of the inner platform; and wherein the intermediate piece provides two separates recesses for insertion of hooks of the inner platform, wherein each recess provides an axial groove having a T-cross section, and wherein each of the hook like extensions having a T-shaped contour for mounting in the intermediate piece.

8. A method for performing maintenance work on a stationary gas turbine engine comprising at least a first row of vanes being mounted at a stationary component arranged radially outside of the first row of vanes and extending radially into an annular entrance opening of an inner component the turbine stage facing a downstream end of a combustor, wherein the stationary component provides for each vane a radially orientated through-hole designed and arranged for a radial insertion and removal of the vane, and each of said vanes including an airfoil having at its one end directed radially outwards a contour being adapted to close the through-hole airtight by a detachable fixation, wherein the airfoil of each of the vanes includes at an end directed radially inwards an extension for inserting into a recess of an inner platform, wherein the inner platform is detachably mounted to an intermediate piece which is detachably mounted to an inner component of the turbine stage, wherein the intermediate piece provides at least one recess for insertion of a hook like extension of the inner platform for axially, radially and circumferential fixation of the inner platform, the method comprising:

gaining access to the detachable fixation of the airfoil of the first row of vanes by entering a casing encapsulating the turbine stage through a manhole inside the casing;

removing the detachable fixation;

removing the airfoil in radial direction through the through-hole;

gaining access to the inner platform by entering the combustor through a further manhole; and removing the inner platform.

9. The method according to claim 8, wherein removing said inner platform is performed by pressing the inner platform radially inwards, moving the inner platform in direction to the combustor and tilting the inner platform for separation.

10. The method according to claim 8, further comprising:

removing the intermediate piece for getting access to the first stage blade.

11. The method according to claim 8, comprising:

reassembling the stationary gas turbine engine by performing each step of the method in a reverse order.

* * * * *